United States Patent [19]

Kohlmann

[11] Patent Number: 5,060,929

[45] Date of Patent: Oct. 29, 1991

[54] SHEET DELIVERY DEVICE WITH AUXILIARY DEPOSIT TABLE

[75] Inventor: Helmut Kohlmann, Karlstadt-Mülbach, Fed. Rep. of Germany

[73] Assignee: Koenig & Bauer Aktiengesellschaft, Wurzburg, Fed. Rep. of Germany

[21] Appl. No.: 546,732

[22] Filed: Jul. 2, 1990

[30] Foreign Application Priority Data

Jul. 15, 1989 [DE] Fed. Rep. of Germany ..... 3923474

[51] Int. Cl.[5] ..... B65H 31/12

[52] U.S. Cl. ..... 271/218; 271/183; 271/204; 271/222; 271/189

[58] Field of Search ..... 271/218, 221, 222, 223, 271/224, 189, 182, 183, 204, 213, 214, 215, 217, 219; 414/789.5, 790.8

[56] References Cited

U.S. PATENT DOCUMENTS

| | | | |
|---|---|---|---|
| 1,512,679 | 10/1924 | Dudley | 271/223 |
| 2,738,973 | 3/1956 | Koch | 271/189 |
| 2,795,420 | 6/1957 | Rooney, Jr. | 271/218 |
| 2,836,418 | 5/1958 | Blattner et al. | 271/183 |
| 3,285,607 | 11/1966 | Lindemann | 271/218 |
| 4,452,442 | 6/1984 | Geschwindner et al. | 271/218 X |
| 4,830,355 | 5/1989 | Jeschke | 271/183 |

FOREIGN PATENT DOCUMENTS

| | | |
|---|---|---|
| 2047808 | 4/1972 | Fed. Rep. of Germany . |
| 2751489 | 2/1979 | Fed. Rep. of Germany . |

*Primary Examiner*—Robert P. Olszewski
*Assistant Examiner*—Boris Milef
*Attorney, Agent, or Firm*—Jones, Tullar & Cooper

[57] ABSTRACT

A pair of back sheet stops are pivotably mounted on a sheet delivery assembly and move in an oscillating manner to align a stack of sheets on a main pile board. As an auxiliary deposit table is inserted above the main sheet pile to allow removal of the main sheet pile while the printing machine is running, the back sheet stops are maintained in contact both with the main sheet pile and also with an interim sheet pile being formed on the auxiliary deposit table.

4 Claims, 3 Drawing Sheets

SHEET DELIVERY DEVICE WITH AUXILIARY DEPOSIT TABLE

FIELD OF THE INVENTION

The present invention is directed generally to a sheet delivery device for a printing machine. More particularly, the present invention is directed to a sheet delivery device having back sheet stops. Most specifically, the present invention is directed to a sheet delivery device with an auxiliary deposit table that can be positioned over the main delivery table. As the auxiliary deposit table is placed over the main delivery table, it contacts the back sheet stops. These back sheet stops, which function to align the rear ends of the sheets which are delivered to either the main or auxiliary sheet deposit table, will remain in contact with the rear surface of the stack of sheets until the auxiliary sheet deposit table is in place above the main deposit table. Thereafter, the back sheet stops will contact the back edges of the sheets on the auxiliary deposit table and will continue to do so until the auxiliary sheet deposit table is removed.

DESCRIPTION OF THE PRIOR ART

In the printing of sheet material in a printing machine, the finished printed sheets are often delivered to some type of sheet stacking table or platform. The printed sheets are typically delivered to this table with a component of forward motion which is stopped when the sheets contact a fixed front stop bar or similar device. Various rear or back sheet stops are also typically used to keep the stack of sheets properly arranged and to prevent the sheet, after it has contacted the front sheet stop, from rebounded rearwardly. Once a suitable stack of sheets has been accumulated on the main sheet delivery table, this stack must be removed. This may be accomplished by placing an auxiliary deposit table over the main sheet deposit table. The printed sheets will then accommodate on the auxiliary deposit table while the sheets on the main sheet deposit table are removed. As the sheets are being delivered to the auxiliary sheet deposit table, they must be kept in a neat stack so that they can then either be removed from the auxiliary table or transferred to the main table.

A sheet delivery assembly which uses a main sheet deposit table and an auxiliary sheet deposit table is shown in German patent specification No. 2,047,808. In this device there are provided back or rear sheet stops which are swung or moved out of the way when the auxiliary sheet deposit table is moved into place to receive the sheets from the sheet delivery transport device. Once the back sheet stops have been swung or moved out of their usual positions, they can no longer serve to align the rear edges of the printed sheets being delivered. However, since it is necessary to maintain the proper alignment of the printed sheets being fed to the auxiliary sheet deposit table, there are provided an additional group of back sheet stops. These additional rear or back sheets stops are lowered into their operative position with respect to the auxiliary sheet deposit table. This is accomplished by the use of an auxiliary system of levers which connect the auxiliary sheet stops with the main or primary back sheet stops. Thus as the primary back sheet stops are moved out of the way, they bring the auxiliary set of back sheet stops into position for use with the auxiliary sheet deposit table.

The arrangement of levers which is utilized to connect the main and auxiliary back sheet stops, as described in the above-referenced patent presents a complex and cumbersome mechanical arrangement. Sheets which are being deposited on the auxiliary sheet deposit table, while it is being pushed into place, are apt to become wedged between the auxiliary sheet stops and the auxiliary deposit table as the auxiliary sheet stops are being lowered into place. This destroys, at the least, those sheets which have become wedged. It also may lead to the formation of an inaccurately and poorly formed stack of sheets or pile. This poorly formed stack or pile of sheets often necessitates stoppage of the printing machine so that the stack ca be corrected and the destroyed or damaged sheets removed. Such stoppage of the printing machine is clearly undesirable and creates lost production and unnecessary downtime.

It will be apparent that a need exists for a back sheet stop assembly for a sheet delivery assembly of a printing machine which can accommodate the placement of an auxiliary sheet deposit table without an interruption in sheet transport. The sheet delivery assembly of the present invention provides such a device and is a substantial improvement over the prior art.

SUMMARY OF THE INVENTION

It is an object of the present invention to provide a sheet delivery assembly for a printing machine.

Another object of the present invention is to provide a sheet delivery assembly which utilizes an auxiliary sheet deposit table.

A further object of the present invention is to provide a sheet delivery assembly having sheet back stops.

Yet another object of the present invention is to provide a sheet delivery assembly having sheet back stops that are operable with both a main sheet deposit table and an auxiliary sheet deposit table.

Still a further object of the present invention is to provide a sheet stop assembly for the sheet back edge of the delivery device of a sheet processing machine.

Even yet another object of the present invention is to provide a sheet stop assembly which maintains the sheets on both the main sheet deposit table and the auxiliary deposit table in the proper alignment during insertion of the auxiliary sheet deposit table.

As will be discussed in greater detail in the description of the preferred embodiment which is set forth hereinafter, the sheet delivery assembly for printing machines in accordance with the present invention utilizes spaced sheet stops for the rear or trailing edges of sheets that are being delivered to a sheet delivery table by a sheet delivery device. An auxiliary sheet delivery table is useable to receive sheets on an interim basis while the sheets on the main sheet table are being removed. As the auxiliary sheet delivery table is put into place, the sheet back stops will contact both the sheet stack on the main sheet delivery table as well as the interim sheet stack being formed on the auxiliary sheet stack table.

The sheet back stop assembly of the present invention provides an apparatus in which the sheets on the main sheet delivery table continue to be aligned during insertion of the auxiliary sheet delivery table. As soon as the auxiliary table is in place, the sheet back stops will be taken out of contact with the sheets on the main sheet delivery table and will start to align the interim stack of sheets being built up on the auxiliary sheet delivery table which is provided with a pair of angled camming surfaces.

These camming surfaces start to contact the sheet back stops as the interim sheet deposit table is being pushed into place. The continued insertion of the auxiliary sheet deposit table raises the sheet back stops with respect to the rear portion of the stack of sheets on the main sheet deposit table. Once the auxiliary sheet deposit table has been fully pushed into place, the camming surfaces have moved the sheet back stops out of contact with the sheets on the main sheet deposit table and will hold these sheet back stops in contact with the sheets on the auxiliary table. Removal of the auxiliary sheet deposit table allows the sheet back stops to return to their original position so that they will contact the rear edges of sheets again being delivered to the sheet delivery table.

The sheet delivery assembly in accordance with the present invention can be produced at a low cost, is not susceptible to failure and is easy to handle. It has a very low maintenance cost and its us results in reduced down time of the printing machine with which is used. Thus it is a significant advance in the art.

BRIEF DESCRIPTION OF THE DRAWINGS

While the novel feature of the sheet delivery assembly for printing machines in accordance with the present invention are set forth with particularity in the appended claims, a full and complete understanding of the invention may be had by referring to the detailed description of the preferred embodiment, as is presented subsequently, and as illustrated in the accompanying drawings, in which:

DETAILED DESCRIPTION OF THE PREFERRED EMBODIMENT

Figure 1:
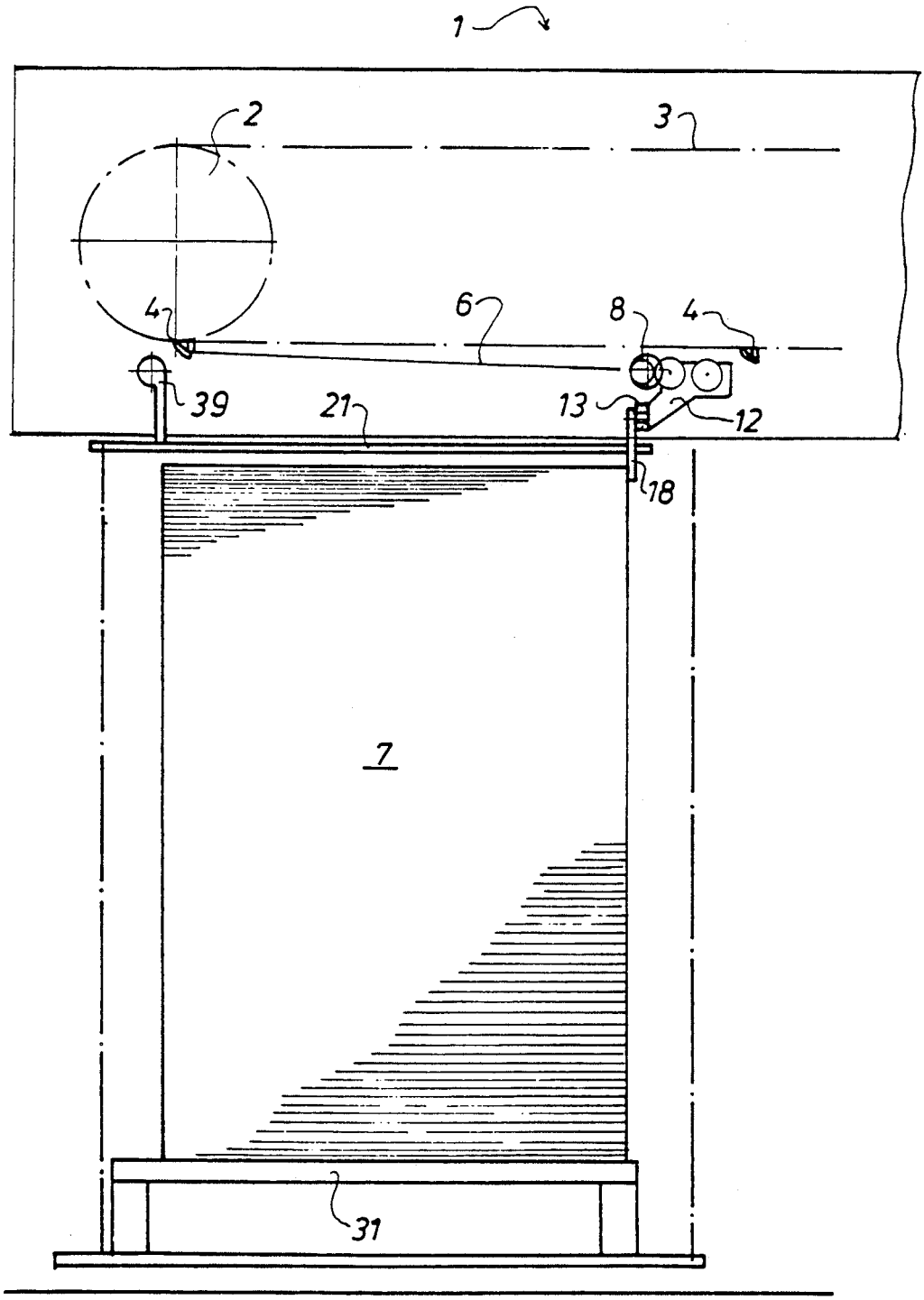
FIG. 1 is a schematic side elevation view of a sheet delivery assembly in accordance with the present invention.

Referring initially to FIG. 1, there may be seen, generally at 1, a preferred embodiment of a sheet delivery assembly for a printing machine in accordance with the present invention. Sheet delivery assembly 1 utilizes a sprocket wheel 2 about which is carried an endless chain 3. A plurality of sheet gripping elements, depicted schematically at 4, are carried by the endless chain 3. A plurality of printed sheets 6, which have been printed in a generally conventional manner by a suitable printing machine (not shown) are gripped by the sheet grippers 4 on the endless chain 3 and are transported to a position generally overlying a main sheet pile 7 which is being built up on a main sheet deposit table or board 31. As the sheets 6 are brought over the main sheet pile 7, the grippers 4 open and allow the sheets 6 to be deposited on the top of the sheet stack 7.

As each sheet 6 is released from the grippers 4, its rear or trailing surface passes over a sheet braking device 8. As may a be seen more clearly in FIG. 4, sheet braking device 8 may be a suction roller which is used to slow down the forward speed of the sheet. This braking roller 8 may be supported by a suitable cross bar or the like (not specifically depicted) so that it can be shifted generally horizontally along the direction of sheet travel to accommodate for different sheet sizes. This movement of sheet brake 8 is accomplished in a generally horizontal direction between the spaced side frames 9 and 11 of the sheet delivery device, as depicted in FIG. 2.

Figure 4:
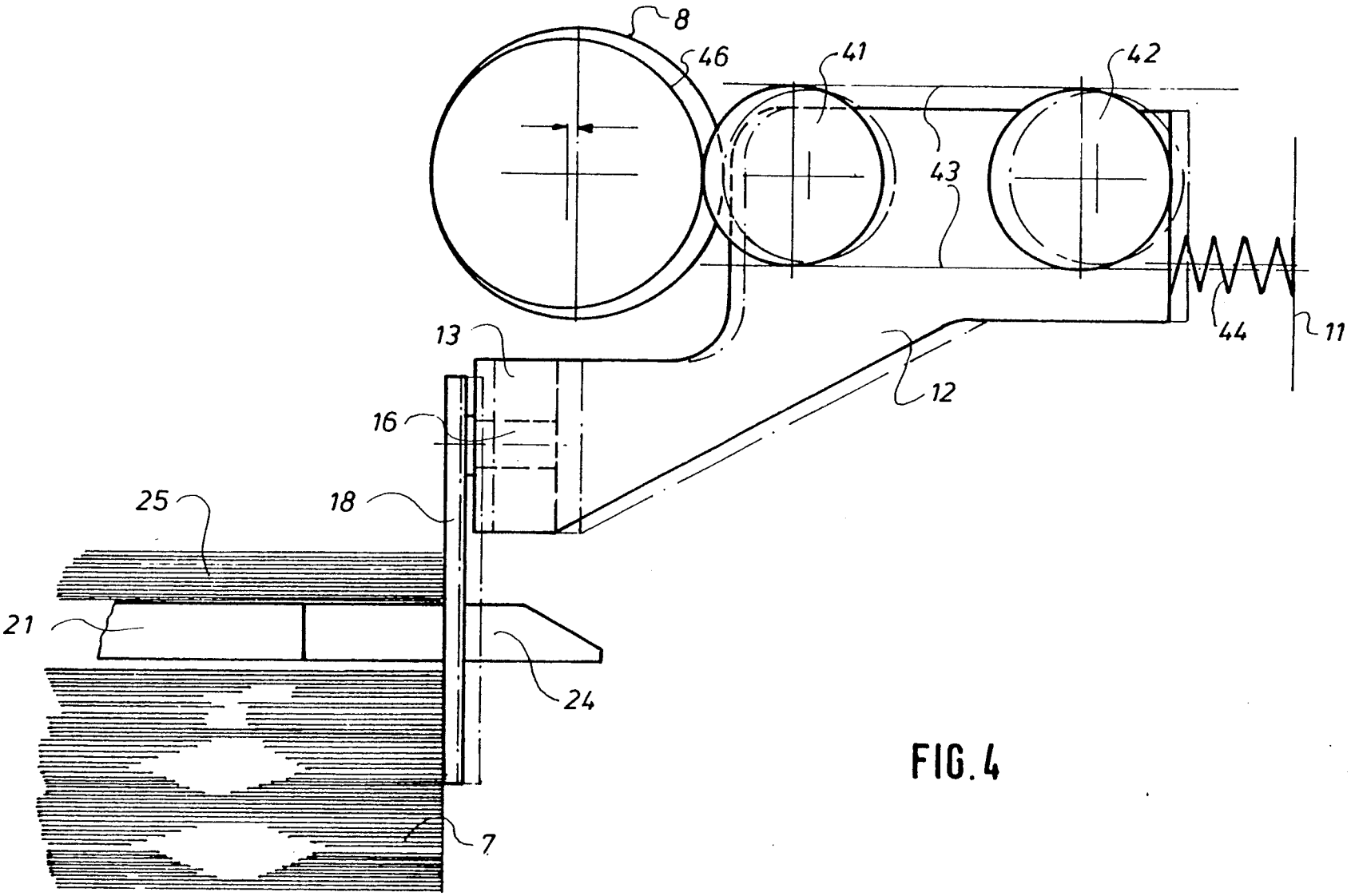
FIG. 4 is an enlarged side elevation view of the sheet delivery assembly and showing the sheet stack back edge and the back sheet stops in accordance with the present invention.

A transverse, generally horizontal elongated bar 13 is positioned generally beneath the brake roller 8, as may be seen in FIGS. 1 and 4. Bar 13 is mounted for horizontal oscillatory movement in the direction of sheet transport. As may be seen most clearly in FIG. 4, this is accomplished by supporting bar 13 on a slide 12. The slide is provided with two spaced rotatably supported rolls 41 and 42 which ar supported in guides 43 that are formed in the side frames 9 and 11. The surface of roll 41, which is the roll adjacent the brake roller 8, is in contact with an eccentrically arranged cam 46 carried by brake roller 8. As the brake roller 8 rotates, the eccentric cam 46 causes the first roll 41 and hence the entire slide 12, together with horizontal bar 13, to oscillate in a generally horizontal direction in the direction of sheet travel. A compression spring 44 is interposed between a rear end of slide 12 and a fixed surface, such as one of the frame members 9 or 11. The compression spring 44 thus acts in opposition to the eccentric cam 46 and urges the slide 12 toward the main sheet pile 7, as may best be seen in FIG. 4.

Figure 2:
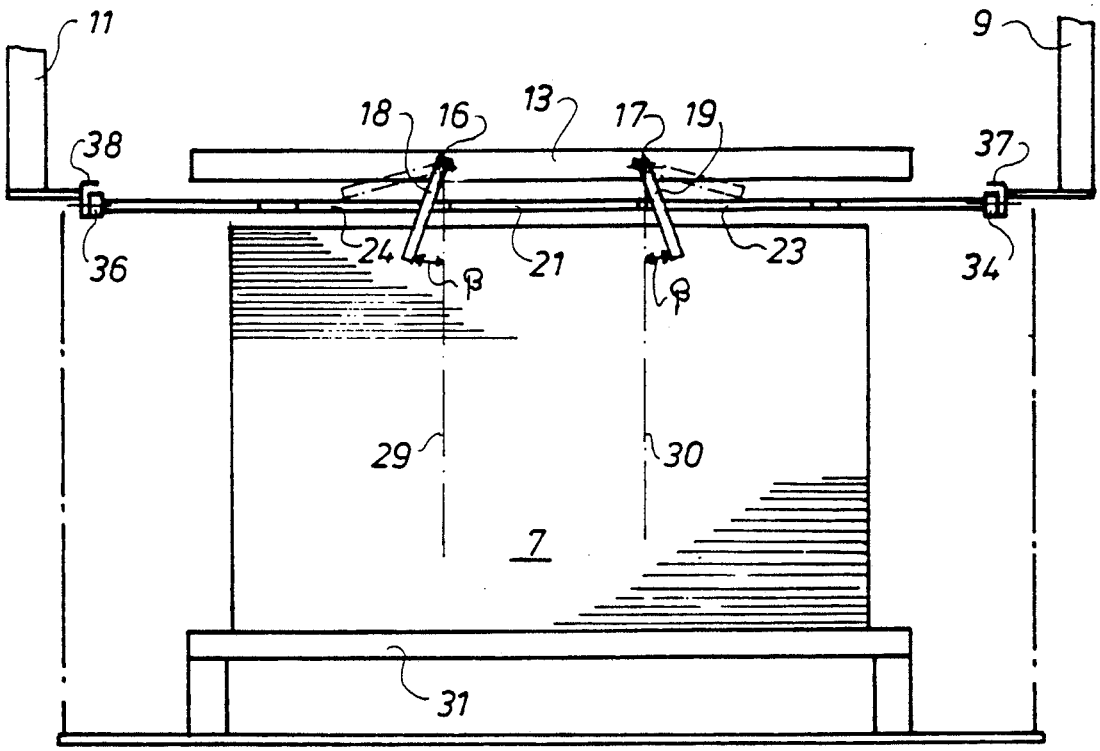
FIG. 2 is a schematic end view, taken in the direction of sheet travel, of the sheet delivery assembly and showing the main sheet pile.

A pair of generally downwardly extending sheet stops 18 and 19 are spaced at a distance "a" from each other and are pivotably attached to bar 13 by use of suitable fasteners, such as pivot bolts 16, and 17, as may be seen most clearly in FIGS. 2 and 4. Since the sheet stops 18 and 19 are affixed to bar 13, they move with bar 13 as it oscillates generally horizontally with, and in opposition to the direction of transport of sheets 6 by endless chain 3. As may be seen in FIG. 1, these sheet stops 18 and 19 will thus repeatedly impact against the rear or back surface of the sheets 8 in the main sheet pile 7. This causes the sheets 6 deposited on the main sheet pile 7 to be pushed forwardly against a suitable front sheet stop 39 whereby the individual sheets 6 are properly aligned in the main sheet pile 7. As may be seen in FIG. 1, front sheet stop 39 is positioned generally beneath sprocket wheel 2 and is pivotably supported by the side frame walls 9 and 11. The two spaced sheet stops 18 and 19 are long enough to cover or contact an upper area of the main sheet pile 7 and thus also form a stop for the sheets 6 in the upper portion of the main sheet pile 7.

Figure 3:
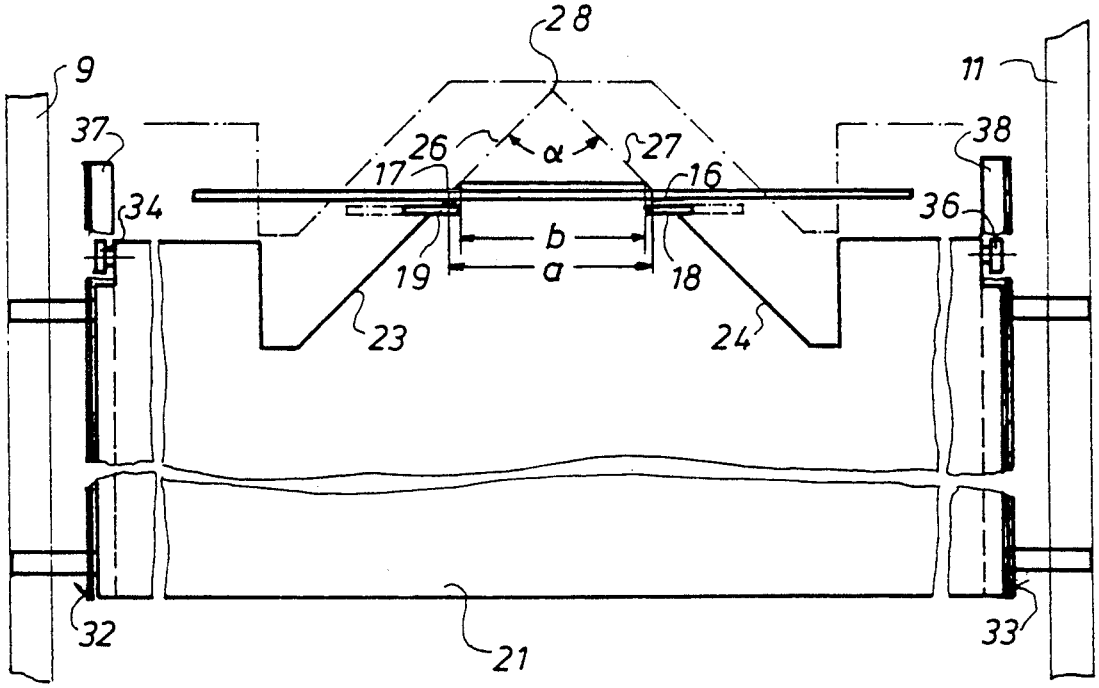
FIG. 3 is a top plan view of the auxiliary sheet deposit table positioned for use.

As may be seen in FIGS. 1, 2, and 3, an interim piling device or sheet support assembly, generally at 21, is insertable into the path of advance of the sheets 6 being carried by sheet delivery assembly 1. The interim piling device or auxiliary deposit table 21 is intended for use when it is desired to remove the main sheet pile 7 from the main sheet board 31 while continuing to deliver sheets 6 on the sheet delivery assembly 1. Thus an interim sheet pile 25, as seen in FIG. 4, will accumulate on the auxiliary deposit table 21 and these sheets 6 in the interim sheet pile 25 will be aligned by the oscillating back sheet stops 18 and 19.

The interim piling device 21 is generally a planar support board which has a plurality of rotatable support rolls 34 and 36 attached to its side surfaces 32 and 33 in a spaced array, as may be seen in FIGS. 2 and 3. These spaced rollers 34 and 36 are receivable in, and are guided by, horizontal rails 37 and 38 which are securely attached to the frame walls 9 and 11 of the sheet delivery assembly, as may best be seen in FIGS. 2 and 3.

As the auxiliary or interim piling device 21 is inserted into place, the back sheet stops 18 and 19 will continue to effect the main stack 7 of sheets 6 on the main sheet board 31, as well as the interim stack 25 of sheets 6 that are being formed on the interim sheet board 21. This dual function of the sheet stops 18 and 19 continues until the interim piling device 21 has been fully inserted into position so that the interim sheet pile 25 is completely separated from the lower main sheet stack 7. When this has occurred, the alignment of the lower main sheet stack 7 is no longer needed and thus when the interim piling device 21 has been fully inserted, the back sheet stops 18 and 19 may be pivoted generally upwardly about their securing bolts 16 and 17, as is depicted by the phantom lines in FIG. 2. This upward pivotal motion of the back sheet stops 18 and 19 is generally in a direction which is generally transverse or crosswise to the direction of insertion of the interim piling device 21. As the interim piling device 21 is fully inserted into position, the back sheet stops come to be on the interim piling device 21. After the back sheet stops 18 and 19 are so positioned, the oscillating movement of the sheet stops 18 and 19 takes place in contact with the upper surface of the interim piling device 21 on which the interim sheet pile 25 is being formed.

As may be seen most clearly in FIG. 3, a leading portion of the interim sheet piling device 21 is structured to effect the pivotal motion of the back sheet stops 18 and 19 during insertion of the interim piling device 21. A pair of spaced angled camming surfaces 23 and 24 are formed on the leading portion of interim piling device 21. These angled camming surfaces 23 and 24 converge toward each other at the leading edge of interim piling device 21 and are spaced from each other by a distance "b" which is less than the spacing distance "a" between the pivot bolts 16 and 17 for the back sheet stops 18 and 19. The angles of the two camming surfaces 23 and 24 are the same and if the two camming surfaces were extended, as depicted by extension lines 26 and 27 in FIG. 3, in the direction of insertion of interim piling device 21, these extension lines 26 and 27 would intersect at a point 28 and would form an acute angle $\alpha$ which may approach about 90°. As seen in FIG. 3, this imaginary point 28 lies in advance of the interim piling device 21 and extends into the path of sheet travel and in opposition to the direction of sheet travel.

As the interim sheet support or piling device 21 is inserted above the built up main sheet pile 7, the spaced camming surfaces 23 and 24 will engage the inner sides of the back sheet stops 18 and 19 and will pivot the sheet stops generally upwardly and outwardly against the force of gravity. When the interim sheet support 21 has been removed, the force of gravity will cause the back sheet stops 18 and 19 to return to their usual positions, as shown in FIG. 2. This return of the sheet stops 18 and 19 to their usual position may be aided by the use of suitable extension or compression springs (not shown). In their usual positions, the back sheet stops 18 and 19 are inclined generally outwardly at a small angle $\beta$ of generally about 15° with respect to the vertical lines 29 and 30. Such positioning may be maintained by suitable stops or other similar means on pivot bolts 16 and 17. This slight outward angle $\beta$ ensures that, as an empty main pile board 31 is raised up into a position to start a new main sheet stack 7, the back sheet stops 18 and 19 will contact the surface of main pile board 31 and will swing or pivot generally outwardly. Thus as the main sheet stack 7 again initially builds on the main pile bound 31, the back sheet stops 18 and 19 will oscillate on the upper surface of the main pile board 31 loaded only by their own weight. As the main sheet stack 7 increases, the main pile board will lower and the back sheet stops 18 and 19 will pivot downwardly until they assume the orientation depicted in FIG. 2.

While a preferred embodiment of a sheet delivery device for a printing machine in accordance with the present invention has been set forth fully and completely hereinabove, it will be apparent to one of skill in the art that a number of changes in, for example, the type of sheet delivery used, the means used to effect the raising and lowering of the main pile board, the type of sheet grippers used and the like could be made without departing from the true spirit and scope of the present invention which is accordingly to be limited only by the following claims.

What is claimed is:

1. A sheet delivery assembly for a printing machine comprising:

means for transporting sheets in a sheet transport direction from a printing machine and for delivering sheets to a main sheet board to form a main sheet pile;

first and second spaced back sheet stops pivotably suspended at first ends at first and second spaced pivot points from an oscillating bar which extends transversely to the sheet transport direction above said main sheet board and which oscillates in the sheet transport direction, said first and second spaced back sheet stops being engageable with a back edge of a main sheet pile on said main sheet board; and an interim sheet piling board which is insertable into said sheet delivery assembly generally in opposition to said sheet transport direction and is positionable above said main sheet pile to support an interim sheet pile, said interim sheet piling board having a front portion including spaced camming surfaces which diverge with respect to each other and which are engageable with said spaced back sheet stops, a central section of said front portion having a width less than a distance between said first and second spaced pivot points, said camming surfaces engaging said spaced back sheet stops during insertion of said interim sheet piling board into said sheet delivery assembly to pivot said back sheet stops about said spaced pivot points, said back sheet stops being in oscillating engagement with back edges of both said main sheet pile and said interim sheet pile during insertion of said interim sheet piling board and with only said back edge of said interim sheet stack upon completion of insertion of said interim sheet piling board.

2. The sheet delivery assembly of claim 1 wherein each of said first and second spaced back sheet stops is attached to said oscillating bar for pivotable movement generally transverse to said direction of sheet transport.

3. The sheet delivery assembly of claim 1 wherein each said back sheet stop is pivotably suspended from said oscillating bar an at angle $\beta$ greater than 0° with respect to the vertical.

4. The sheet delivery assembly of claim 1 wherein an elongation of said spaced camming surfaces intersect in an acute angle.

* * * * *